US008735747B2

(12) United States Patent
Bigand

(10) Patent No.: US 8,735,747 B2
(45) Date of Patent: May 27, 2014

(54) COMPACT DOUBLE-CONTACT SECURED PUSHBUTTON SWITCH

(75) Inventor: Jean-Louis Bigand, Vendôme (FR)

(73) Assignee: Thales, Neuilly-sur-Seine (FR)

( * ) Notice: Subject to any disclaimer, the term of this patent is extended or adjusted under 35 U.S.C. 154(b) by 0 days.

(21) Appl. No.: 13/314,037

(22) Filed: Dec. 7, 2011

(65) Prior Publication Data

US 2012/0305372 A1 Dec. 6, 2012

(30) Foreign Application Priority Data

Dec. 10, 2010 (FR) ..... 10 04818

(51) Int. Cl.

| | |
|---|---|
| ***H01H 9/00*** | (2006.01) |
| ***H01H 13/14*** | (2006.01) |
| ***H01H 13/702*** | (2006.01) |
| ***H01H 13/88*** | (2006.01) |

(52) U.S. Cl.

CPC ..... *H01H 13/14* (2013.01); *H01H 13/702* (2013.01); *H01H 13/88* (2013.01); *H01H 2221/026* (2013.01); *H01H 2203/038* (2013.01); *H01H 2225/018* (2013.01)

USPC ..... 200/1 B; 200/5 A; 200/341; 200/520

(58) Field of Classification Search

CPC ..... H01H 13/14; H01H 13/702; H01H 13/88; H01H 13/64; H01H 221/026; H01H 2203/038; H01H 2225/018

USPC ..... 200/1 B, 5 A, 5 R, 341, 344, 406, 516, 200/517, 520

See application file for complete search history.

(56) References Cited

U.S. PATENT DOCUMENTS

| | | | | |
|---|---|---|---|---|
| 4,194,105 | A * | 3/1980 | Hodges | 200/517 |
| 5,343,008 | A * | 8/1994 | Ipcinski | 200/302.2 |
| 5,898,147 | A * | 4/1999 | Domzalski et al. | 200/1 B |
| 6,492,602 | B2 * | 12/2002 | Asai et al. | 200/1 B |
| 6,639,159 | B2 * | 10/2003 | Anzai | 200/1 B |
| 6,995,324 | B2 * | 2/2006 | Asada | 200/1 B |
| 8,071,897 | B2 * | 12/2011 | Chiu | 200/5 A |
| 2006/0185971 | A1 | 8/2006 | Rochon | |

FOREIGN PATENT DOCUMENTS

| | | | |
|---|---|---|---|
| EP | 1589552 | A1 | 10/2005 |
| FR | 2859567 | A1 | 3/2005 |
| JP | 8111134 | A | 4/1996 |

* cited by examiner

*Primary Examiner* — Kyung Lee
(74) *Attorney, Agent, or Firm* — Baker & Hostetler LLP

(57) ABSTRACT

A pushbutton switch comprises a plunger, which provokes, under the action of pressure by a user, the depression of an upper dome positioned above switching means, any depression of the upper dome necessarily provoking the depression of the switching means, the crest of the upper dome and the switching means having a down position, a first electric contact being produced between a primary contact and a secondary contact of the upper dome forming a first electric circuit when the crest of the upper dome is in the down position, and a second electric contact being produced between a primary contact and a secondary contact of the switching means forming a second electric circuit when the switching means are in the down position.

13 Claims, 9 Drawing Sheets

COMPACT DOUBLE-CONTACT SECURED PUSHBUTTON SWITCH

CROSS-REFERENCE TO RELATED APPLICATION

This application claims priority to foreign French patent application No. FR 1004818, filed on Dec. 10, 2010, the disclosure of which is incorporated by reference in its entirety.

FIELD OF THE INVENTION

The present invention relates to a compact double-contact secured pushbutton switch. It applies notably to the field of electric switches with a single-function pushbutton, or a redundant or secured function, intended to initiate critical functions, used for example in the aeronautical field.

BACKGROUND

The electric switches intended to initiate critical functions, used for example on aircraft instrument panels, must satisfy a certain number of constraints. Notably, certain functions require their operation to be effected via pressure on a switch that is redundant from an electrical point of view, that is to say, a switch that simultaneously establishes the electric contact for at least two electric circuits implementing, for example, a single function, the two electric circuits having no common electric mode. Such is, for example, the case in aircraft, for the switches initiating an automatic pilot device. For such applications, it is also preferable for the switches positioned on the instrument panel to be of compact structure. Furthermore, it is desirable for the tactile sensation provided to a user by the switch on an action thereon to be pleasant, and provide feedback information enabling the user to confirm the correct accomplishment of the action initiated.

Pushbutton switches of the "dome" switch type, often simply called "dome switches" are notably commonly used in aircraft instrument panels. In this type of switch, the electric switching is performed by the depression or "deflection" of a conductive elastic blister dome against two conductors to be linked together. The dome switches are not intrinsically provided with systems for ensuring the electrical redundancy; however, there are solutions known in the art, for secured dome switches. Notably, according to one known technique, a switch makes it possible, by a mechanical action, to activate two electric contacts positioned one alongside the other and activated by one and the same surface of the switch. The assembly may form a pushbutton switch that can be mounted, for example, on the front of an instrument panel, for example by soldering. A drawback associated with this technical solution lies in the fact that producing such a switch is difficult, in as much as the two electric contacts have to be activated simultaneously. The simultaneous activation of the two electric contacts is all the more difficult when the pushbutton of the switch is pressed on the edges or else on the crest thereof. In fact, in such a case, it is possible for only one contact of the two to be made. It is possible to overcome this drawback by equipping the switch with accurate guiding devices, but to the detriment of the cost of manufacture and to the price of spurious friction effects detrimental to the comfort of the user. Furthermore, the guiding systems may lead to problems caused by the switch becoming jammed, due, for example, to bracing effects.

SUMMARY OF THE INVENTION

One aim of the present invention is to overcome at least the abovementioned drawbacks, proposing a secured pushbutton switch of compact structure, providing enhanced usage comfort.

One advantage of the invention lies in the fact that the practical production of a switch according to one of the embodiments described has a reasonable cost.

Another advantage of the invention lies in the fact that a switch according to one of the embodiments described offers a dependability, reliability and a lifetime that are all improved.

To this end, the subject of the invention is a pushbutton switch comprising a plunger, the plunger provoking, under the action of pressure by a user, the depression of an upper dome positioned above switching means, any depression of the upper dome necessarily provoking the depression of the switching means, the crest of the upper dome and the switching means having a down position, a first electric contact being produced between a primary contact and a secondary contact of the upper dome forming a first electric circuit when the crest of the upper dome is in the down position, and a second electric contact being produced between a primary contact and a secondary contact of the switching means forming a second electric circuit when the switching means are in the down position.

In one embodiment of the invention, the switching means may be formed by a lower dome.

In one embodiment of the invention, the switching means may be formed by a flexible metal platelet.

In one embodiment of the invention, the upper dome and lower dome may be configured so that the force required to depress the upper dome is greater than the force required to depress the lower dome.

In one embodiment of the invention, the upper dome and the lower dome may be configured so that the force required to depress the upper dome is greater than the force required to depress the flexible metal platelet.

In one embodiment of the invention, said first and second electric circuits may not have any electric common mode.

In one embodiment of the invention, said first and second electric circuits may ensure the activation of a redundant or secured function.

In one embodiment of the invention, the pushbutton switch may comprise an intermediate mobile part positioned below the upper dome and above the switching means, the intermediate mobile part being electrically conductive at least in its upper portion, and electrically linked to the secondary contact of the upper dome, the depression of the upper dome resulting in the closure of said first electric circuit, and the depression of the switching means being brought about by the displacement of the intermediate mobile part, the top surface of the lower dome and/or the bottom surface of the intermediate mobile part being electrically insulating.

In one embodiment of the invention, the intermediate mobile part may be positioned on a flexible and electrically conductive beam, the beam being fixed at at least one point of the secondary contact of the upper dome by fixing means.

In one embodiment of the invention, said primary contact and/or the secondary contact of the upper dome, and/or the primary contact and/or the secondary contact of the switching means may be formed by metallizations produced on a printed circuit card or by encapsulated metal platelets.

In one embodiment of the invention, the upper dome and the lower dome may be configured so that the depression of the lower dome is initiated after inversion of the upper dome, the travel-force characteristics of the upper and lower domes allowing for the depression of the upper and lower domes in return for a force that is at least equal to the force required to depress the upper dome alone.

In one embodiment of the invention, the pushbutton switch according to one of the embodiments of the invention may be directly mounted on a printed circuit card.

In one embodiment of the invention, the pushbutton switch according to one of the embodiments of the invention may be arranged in a housing which can be mounted on an instrument panel.

BRIEF DESCRIPTION OF THE DRAWINGS

Other features and advantages of the invention will become apparent from reading the description, given as an example, and in light of the appended drawings which represent.

DETAILED DESCRIPTION

Figure 1A:
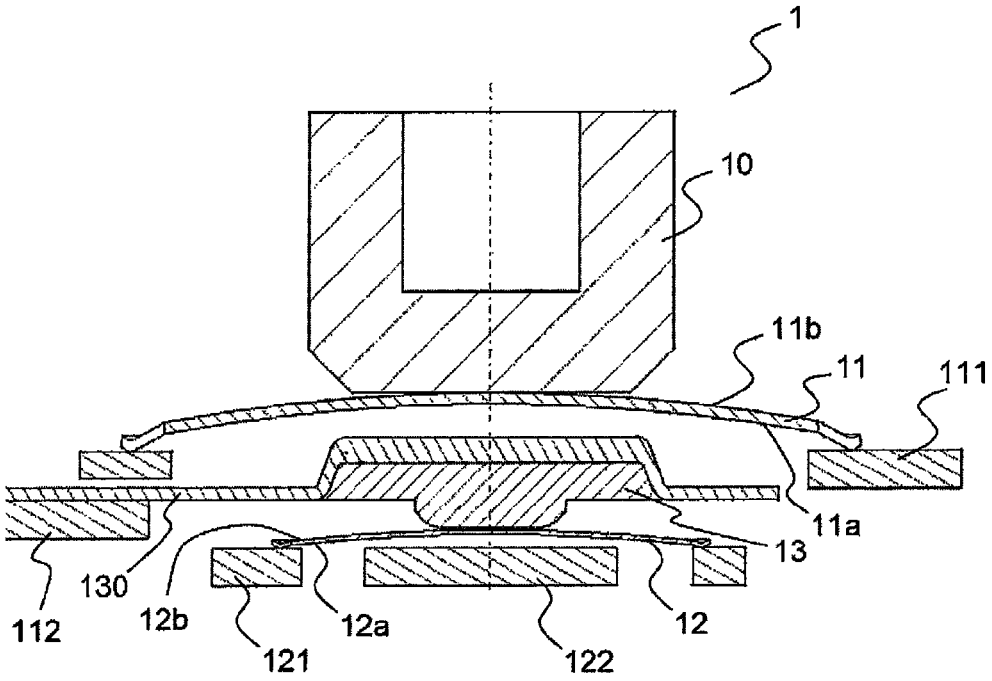
FIGS. 1*a* to 1*f*, cross-sectional views illustrating an exemplary pushbutton switch according to one embodiment of the invention, in different typical operating steps.

Referring to FIG. 1*a*, a pushbutton switch 1 may comprise, in an exemplary embodiment, an actuator or "plunger" 10. The plunger 10 is positioned above the crest of an upper dome 11 produced in an electrically conductive material. Switching means, for example formed by a lower dome 12, are positioned below the upper dome 11. The upper dome 11 notably comprises a bottom surface 11*a* and a top surface 11*b*. Similarly, the lower dome 12 comprises a bottom surface 12*a* and a top surface 12*b*.

Advantageously, the diameter of the upper dome 11 is chosen to be greater than the diameter of the lower dome 12. According to a specific feature of the present invention, the depression of the upper dome 11 should systematically result in the depression of the lower dome 12, so that one and the same activation force exerted by the user on the plunger 10 will allow for the depression of both domes 11, 12. Thus, the force required to depress the upper dome 11 is greater than the force required to depress the lower dome 12.

An intermediate mobile part 13 is positioned between the upper dome 11 and the lower dome 12. The plunger 10 and the domes 11, 12 may, for example, exhibit symmetry of revolution about a vertical axis, the plunger 10 being, for example, positioned in a cage which is not represented in the figure, limiting its movements to one degree of freedom in the direction of the vertical axis. In the example illustrated by the figures, the plunger 10, the domes 11, 12 and the intermediate mobile part 13 have main axes aligned with the abovementioned vertical axis.

The plunger 10 may be produced in a material of elastomer type whose characteristics provide a good comfort for a user exerting a pressure thereon, and may, for example, be covered with a flexible cap produced in an elastomer material, or else a rigid cap, not represented in the figures. The upper dome 11 rests on a primary contact 111 and is in electric contact therewith. The primary contact 111 may, for example, be formed by a metal track of a printed circuit card. At rest, that is, in the absence of force exerted thereon, the crest of the upper dome 11 occupies a so-called "up" nominal position.

The lower dome 12 rests on a primary contact 121 and is in electric contact therewith, possibly also for example being formed by a metal track of a printed circuit card. When an appropriate pressure is exerted on the lower dome 12, the crest thereof comes, after deflection, into contact with a secondary contact 122 of the lower dome 12. The bottom surface 12*a* of the lower dome 12 is electrically conductive.

Figure 1B:
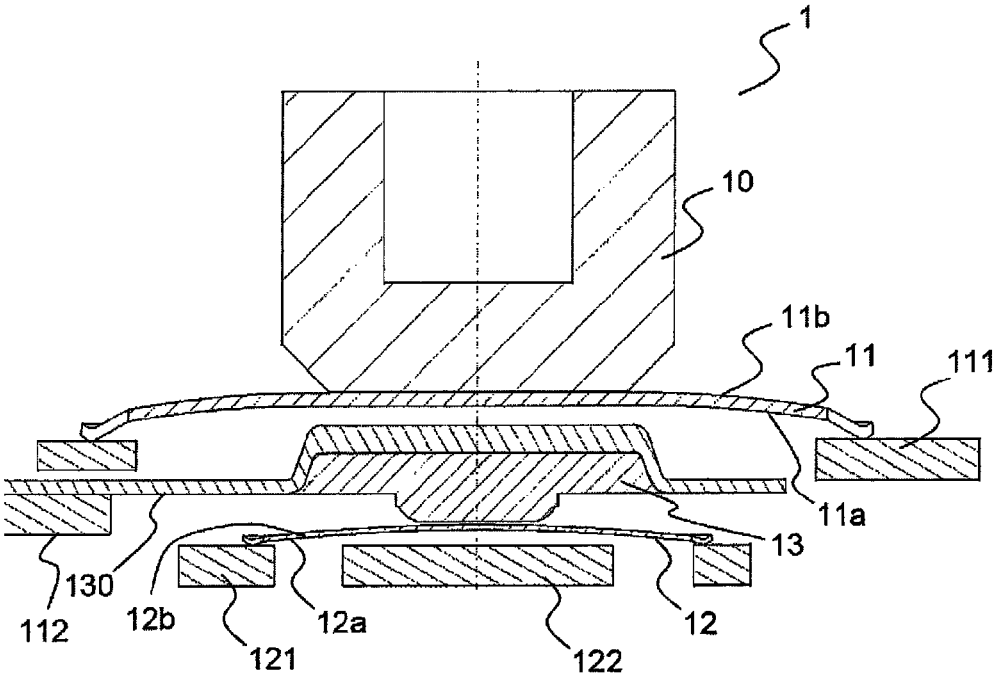
Figure 1C:
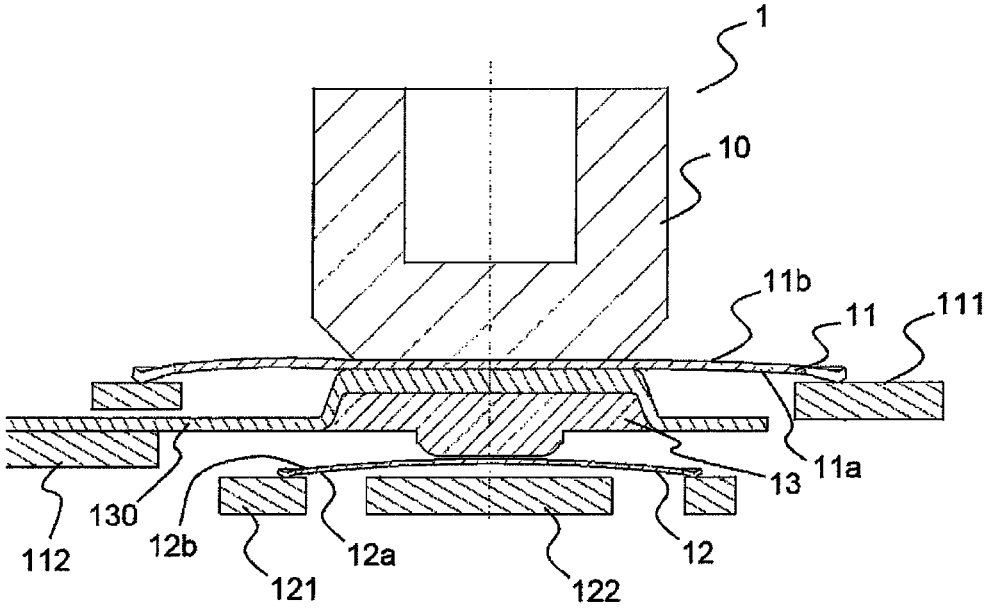
Figure 1D:
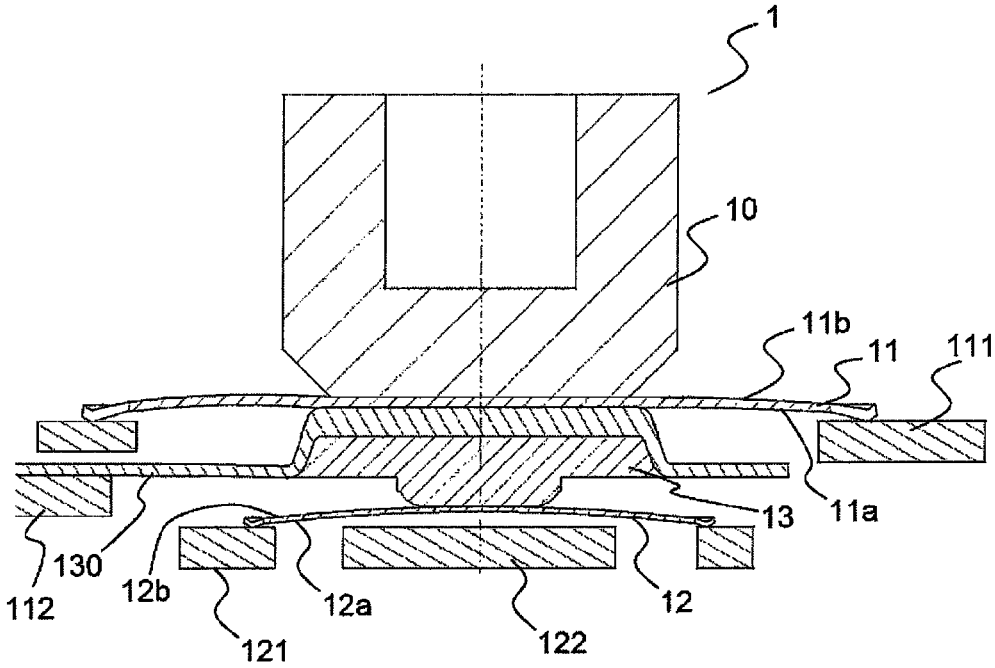
Figure 1E:
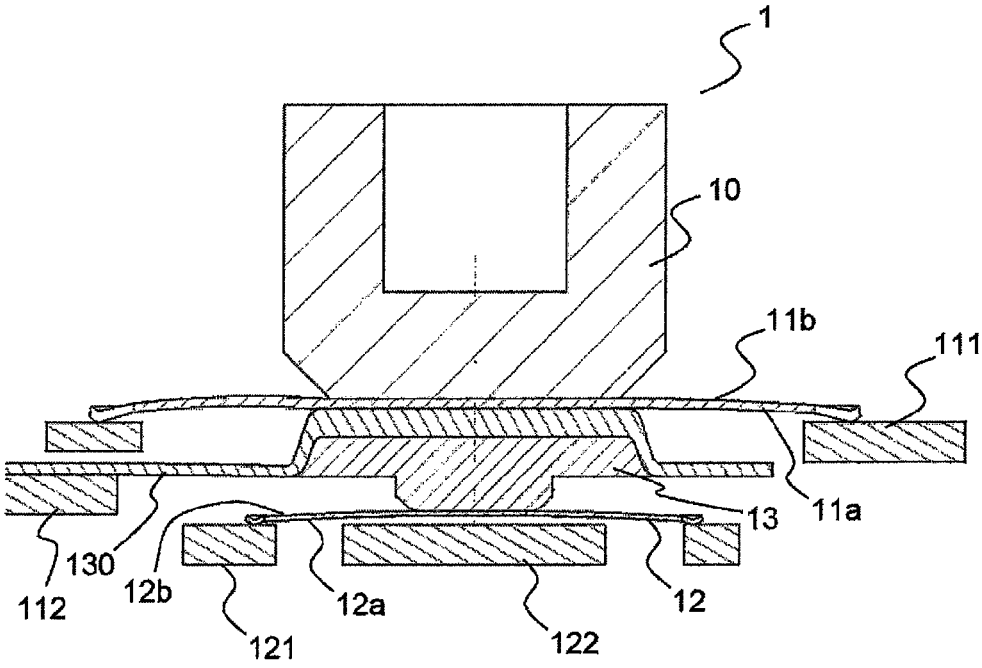
Figure 1F:
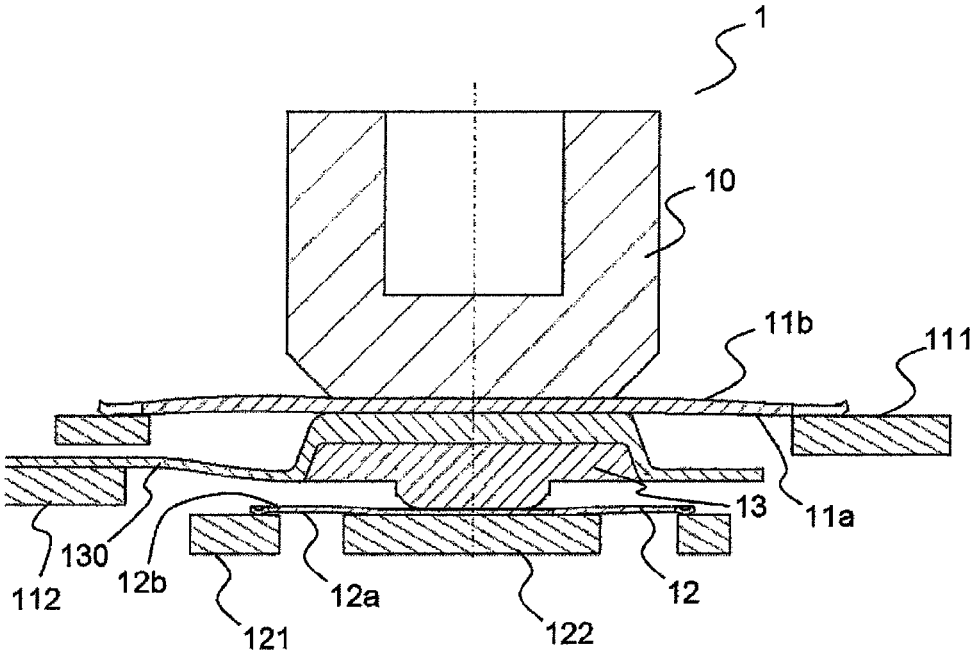

As is illustrated in FIG. 1*f*, when the crest of the lower dome 12 is, after deflection, in a so-called down position, electric contact is established between the primary contact 121 and the secondary contact 122 of the lower dome 12. The primary contact 121 and the secondary contact 122 of the lower dome 12 are substantially in one and the same plane, and may, for example, both be formed by metallizations formed on a printed circuit board.

The deflection of the lower dome 12 is applied by the displacement of the intermediate mobile part 13. The displacement of the intermediate mobile part 13 is provoked by the deflection of the upper dome 11, which is in turn provoked by the pressure by a user on the plunger 10.

In a manner similar to the lower dome 12, the crest of the upper dome 11 occupies, in the absence of forces exerted on the plunger 10, a so-called "up" nominal position, and a down position after deflection. Also, the bottom surface 11*a* of the upper dome 11 is electrically conductive.

The intermediate mobile part 13 is made of an electrically conductive material, at least in its upper portion. The intermediate mobile part 13 is electrically linked to the secondary contact 112 of the upper dome 11. As is illustrated in the examples shown by FIGS. 1*a* to 1*f*, the intermediate mobile part 13 may be physically and electrically linked to the secondary contact 112 of the upper dome 11 via a beam 130 made of a conductive material, for example a metal spring plate passed through by the intermediate mobile part 13. The beam 130 should be designed so as to generate a minimum of disturbing forces when it is deformed. The beam 130 may be fixed to the secondary contact 112 of the upper dome, at one or more points, for example by solder joints, or else by screwing, crimping or any other known fixing means. It should be observed that, in the exemplary embodiment illustrated by FIGS. 1*a* to 1*f*, the intermediate mobile part 13 is shown countersunk in the beam 130, and consequently the intermediate mobile part 13 is not in direct contact, when the upper dome 11 is depressed, with the bottom surface 11*a* of the upper dome 11. Also, in such a configuration, the intermediate mobile part 13 may be made entirely of an electrically insulating material, and it is the beam 130 which ensures the electric contact between the primary contact 111 and the secondary contact 112 when the bottom surface 11*a* of the upper dome 11 is in contact with the beam 130; it is then not necessary for the top surface 12*b* of the lower dome 12 to be electrically insulating. In alternative embodiments, the intermediate mobile part 13 may, for example, be entirely electrically conductive, and, for example, extend on either side of the beam 130 and then be directly in contact in its upper portion with the bottom surface 11*a* of the upper dome 11, when the upper dome 11 is depressed; in such a case, it is essential for the lower portion of the intermediate mobile part 13 and/or the top surface 12*b* of the lower dome 12 to be electrically insulating, for example by being covered with an insulating film.

It should be noted that the intermediate mobile part 13 is independent, from a mechanical point of view, of the upper 11 and lower 12 domes. The intermediate mobile part 13 also provides the advantage of forming an actuator that is appropriate to the lesser diameter of the lower dome 12, that is to say an actuator whose dimensions can be chosen so as to be compatible with the dimensions of the lower dome 12. This way, it is possible to guarantee a prolonged life of the dome with the smaller diameter.

Thus, when the crest of the upper dome 11 is in contact with the upper portion of the intermediate mobile part 13, an electric contact is made between the secondary contact 112 and the primary contact 111 of the upper dome 11, via the beam 130, the intermediate mobile part 13 and the electrically conductive bottom surface 11*a* of the upper dome 11, these two elements then being in direct contact with one another.

So that there is no common electric mode between the two electric circuits closed by the deflection of the domes 11, 12, that is to say, respectively the first electric circuit formed by the primary contact 111 and the secondary contact 112 of the upper dome 11 and the second electric circuit formed by the primary contact 121 and the secondary contact 122 of the lower dome 12, the top surface 12*b* of the lower dome 12 and/or the bottom surface of the intermediate mobile part 13 may, for example, be covered with an electrically insulating material, formed, for example, by a layer of lacquer or an insulating film or by the addition of a part made of a plastic material.

Typically, when no force is exerted by the user on the plunger 10, the elements forming the subsystem notably comprising the upper dome 11, intermediate mobile part 13, lower dome 12 and secondary contact 122 of the lower dome 12 are not in direct contact with one another. When, under the pressure of the plunger 10, the upper and lower domes 11, 12 are, after deflection, in their respective down positions, all the abovementioned elements are in contact with one another, and the abovementioned first and second electric circuits are then closed.

FIGS. 1*b* to 1*e* illustrate intermediate configurations of the elements forming the pushbutton switch 1, during the travel of the plunger 10 between a nominal configuration illustrated by FIG. 1*a*, and a configuration of electric contact illustrated by FIG. 1*f*. FIGS. 1*b* to 1*e* are described below:

FIG. 1*b* illustrates a configuration in which the depression of the upper dome 11 has been initiated by the displacement of the plunger 10, the bottom surface thereof being in contact with the top surface 11*b* of the upper dome 11. In the example illustrated by FIG. 1*b*, the upper dome 11 is in its inversion position. In this configuration, according to the example illustrated by the figure, only the plunger 10 and the upper dome 11 are in contact;

FIG. 1*c* illustrates a configuration in which the bottom surface 11*a* of the upper dome 11 is in contact with the upper portion of the intermediate mobile part 13, the latter not yet having begun to move. In this configuration, the first electric circuit as defined previously, is closed;

FIG. 1*d* illustrates a configuration in which the intermediate mobile part 13 is displaced under the action of the travel of the plunger 10, via the upper dome 11. In this configuration, the lower portion of the intermediate mobile part 13 has entered into mechanical contact with the top portion 12*b* of the lower dome 12: the first electric circuit is still closed, and the second electric circuit is not yet closed. The depression of the lower dome 12 is initiated;

FIG. 1*e* illustrates a configuration in which the lower dome 12, under the action of the displacement of the intermediate mobile part 13 via the displacement of the upper dome 11 under the action of the plunger 10, reaches its inversion point. In this configuration, the first electric circuit is still closed, and the second electric circuit is not yet closed.

The displacement of the plunger 10 then imposes, via the intermediate elements situated between it and the lower dome 12, a displacement of the crest of the lower dome 12 until the latter reaches abutment, where the electric contact between the bottom surface 12*a* of the lower dome 12 and the secondary contact 122 of the lower dome 12 is established, that is to say, where the second electric circuit is closed, as is illustrated by FIG. 1*f*.

The dimensioning of the upper and lower domes 11, 12, of the intermediate mobile part 13, the configuration and the characteristics of the abovementioned elements, are defined in such a way that the deflection of the upper dome 11 results in the deflection of the lower dome 12, and that the closure of the abovementioned two electric circuits is produced simultaneously or quasi-simultaneously, or typically in an interval of around a microsecond, corresponding to the sequencing of the configurations described previously and illustrated by FIGS. 1*a* to 1*f*.

Notably, the travel-force characteristics of the domes 11, 12 are defined in such a way that the tactile sensation on the part of the user is similar to the sensation obtained by the pressure of a simple switch of conventional type. Thus, the force required by the user to provoke the depression of the two domes 11, 12 can advantageously be at most equal to the force required to depress the upper dome 11 alone. An example of these characteristics is described below with reference to FIG. 2.

Figure 4:
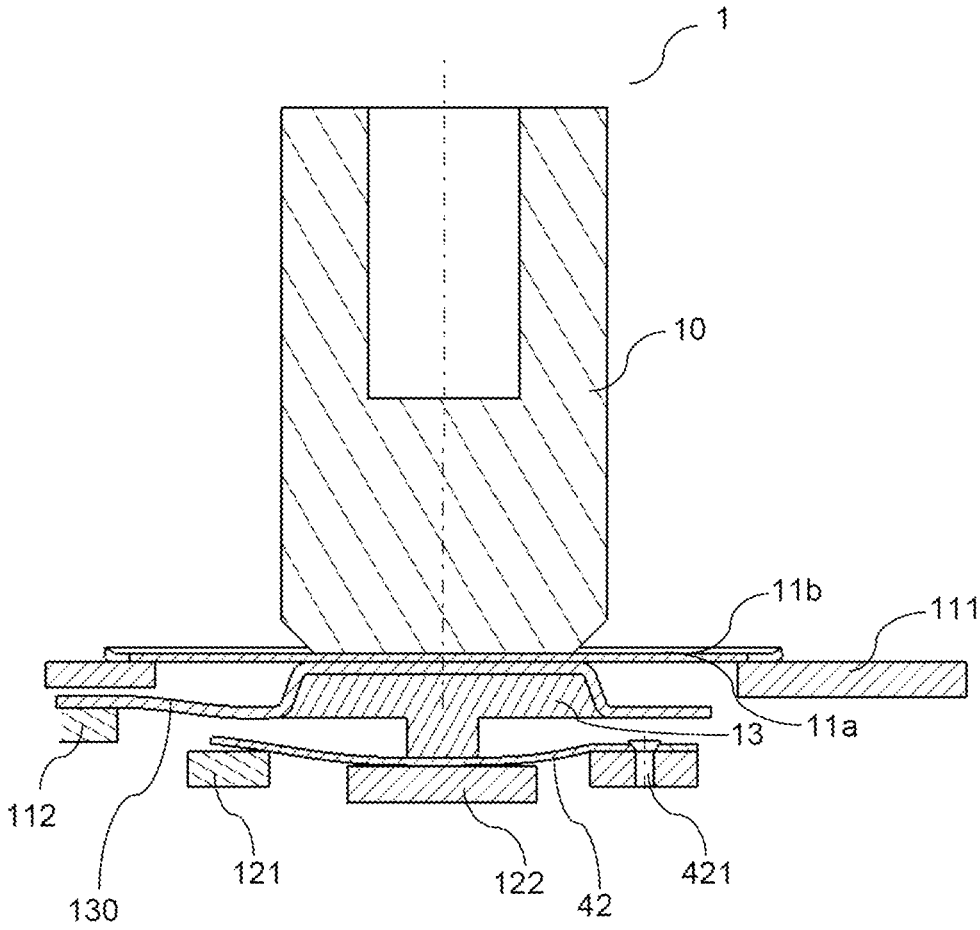
FIG. 4, a cross-sectional view illustrating an exemplary pushbutton switch, according to an alternative embodiment of the invention.

It should be noted that, in the exemplary switch described above with reference to FIGS. 1*a* to 1*f*, switching means of the lower electric circuit are formed by the lower dome 12. The switching means of the lower circuit may also be formed by alternative devices, and the lower dome 12 may thus, for example, be substituted by a flexible metal platelet, having a position in which it does not enter into contact with the secondary contact 122, and a position which can be likened to a depressed position of the lower dome 12, in which the platelet is in contact with the secondary contact 122, the second electric circuit thus being closed. Such an exemplary embodiment is illustrated by FIG. 4, described below.

Figure 2:
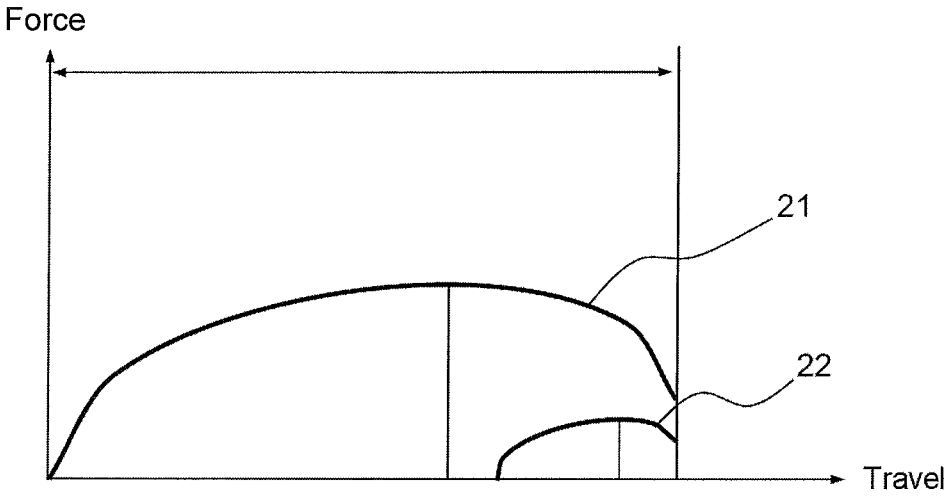
FIG. 2, a graphic representation illustrating force curves relating to the domes included in a pushbutton switch according to one embodiment of the invention.

FIG. 2 shows curves illustrating force curves relating to a pushbutton switch according to one embodiment of the invention.

A first force curve 21 represents the force applied to the crest of the upper dome 11, as a function of the travel thereof, from its up position to its down position. Similarly, a second force curve 22 represents the force applied to the crest of the lower dome 12, as a function of the travel thereof, from its up position to its down position.

Typically, with reference to the first force curve 21 and initially disregarding the influence of the lower dome, the force to be exerted by the user tends to increase as soon as the depression of the upper dome is initiated, to a point illustrated by the summit of the first force curve 21, corresponding to the inversion of the upper dome. From the inversion point, the force decreases until the upper dome is completely deflected, corresponding to a point of mechanical abutment and of electric connection. The appearance of the first force curve 21 is substantially symmetrical around the vertical axis passing through the inversion point.

Similarly, referring to the second force curve 22 and disregarding the influence of the upper dome, the force exerted on the lower dome tends to increase when the depression of the lower dome is initiated, to a point illustrated by the summit of the second force curve 22, corresponding to the inversion of the lower dome. From the inversion point, the force decreases until the lower dome is completely deflected, corresponding to a point of mechanical abutment and of electric connection. The appearance of the second force curve 22 is substantially symmetrical around the vertical axis passing through the inversion point.

In the example illustrated by FIG. 2, the depression of the lower dome is initiated after the inversion of the upper dome. Assuming that the plunger is made of a perfectly rigid material, the force to be exerted over the entire travel thereof as far as the electric switching of the two electric circuits, is equal to the sum of the forces being applied to the two domes. In practice, if the plunger is formed by a material offering a relative elasticity, the reaction to the force exerted by the user at the end of switching is perceived in a quasi-continuous manner, because of the elastic characteristics of the material forming the plunger on the one hand, and the elastic characteristics of the end of the finger of the user exerting the pressure force. In practice, the elastomer plunger erases the tactile discontinuity of the lower dome 12 by the restoration of the energy stored in its compression during the force ramp-up phase.

FIGS. 3*a* to 3*d* show travel-force curves in different configurations of a practical exemplary embodiment of the present invention.

Figure 3A:
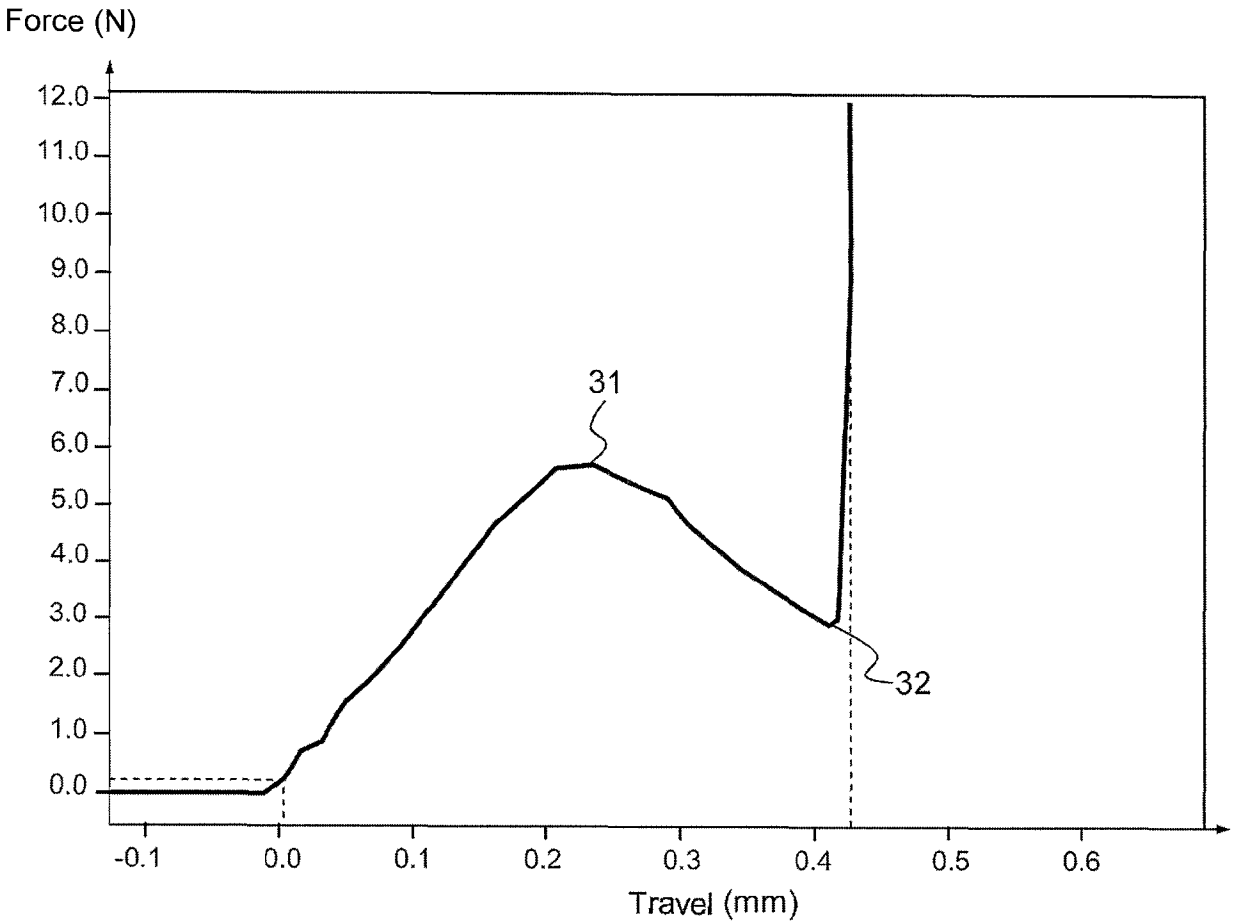
FIGS. 3*a* to 3*d*, graphic representations illustrating different force curves relating to a practical exemplary embodiment of the invention.

FIG. 3*a* shows the travel-force curve relating to a practical exemplary embodiment of the upper dome. The force exerted on the dome increases continuously with the travel of the crest thereof, to a first characteristic point 31 corresponding to the inversion of the upper dome. From the first characteristic point 31, the force decreases continuously with the travel, to a second characteristic point 32, corresponding to a mechanical abutment, and to the electric switching.

Figure 3B:
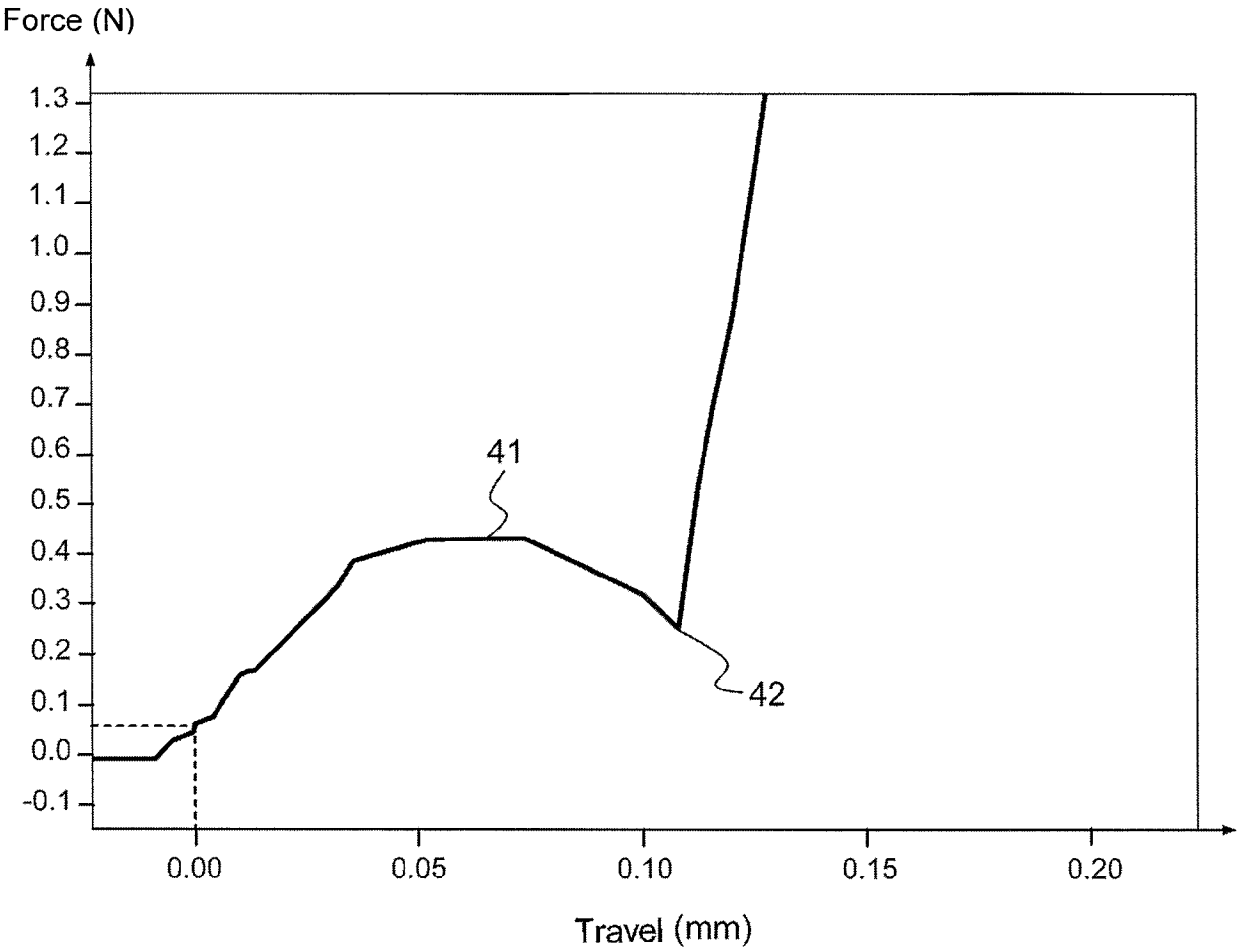

FIG. 3*b* shows the travel-force curve relating to a practical exemplary embodiment of the lower dome. The curve has an appearance similar to the curve relating to the upper dome described with reference to FIG. 3*a*; however, the travels and the forces are significantly lower. Similarly, the travel-force curve relating to the lower dome exhibits a first characteristic point 41 corresponding to the inversion of the lower dome, and a second characteristic point 42 corresponding to the mechanical abutment and to the electric switching ensured by the lower dome.

Figure 3C:
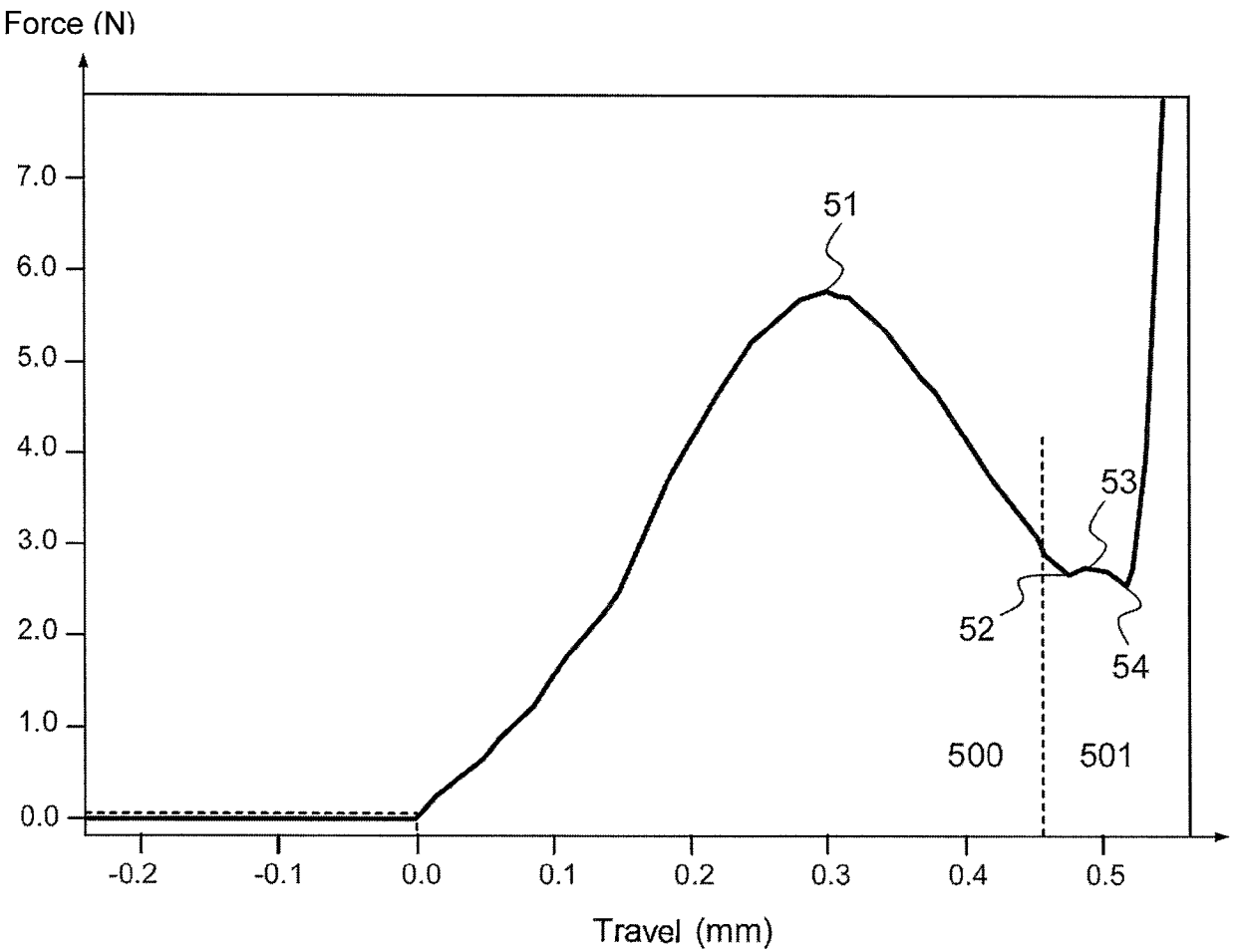

FIG. 3*c* shows the travel-force curve relating to a practical exemplary embodiment of the upper dome positioned above the lower dome via an intermediate mobile part. In the example illustrated, in a first area 500 extending beyond the inversion point 51 of the upper dome, the appearance of the travel-force curve is identical to the travel-force curve of the upper dome alone. From a travel corresponding to the start of a second area 501, the depression of the lower dome is initiated; the travel-force curve then represents the superimposition of the two curves illustrated with reference to FIGS. 3*a* and 3*b*. The force decreases when the travel increases, to a fracture point 52 corresponding to the total depression of the upper dome. From the fracture point 52, the force increases slightly with the travel to an inversion point 53 of the lower dome. Then, the force decreases when the travel increases, to a point of mechanical abutment and of electric contact 54.

Figure 3D:
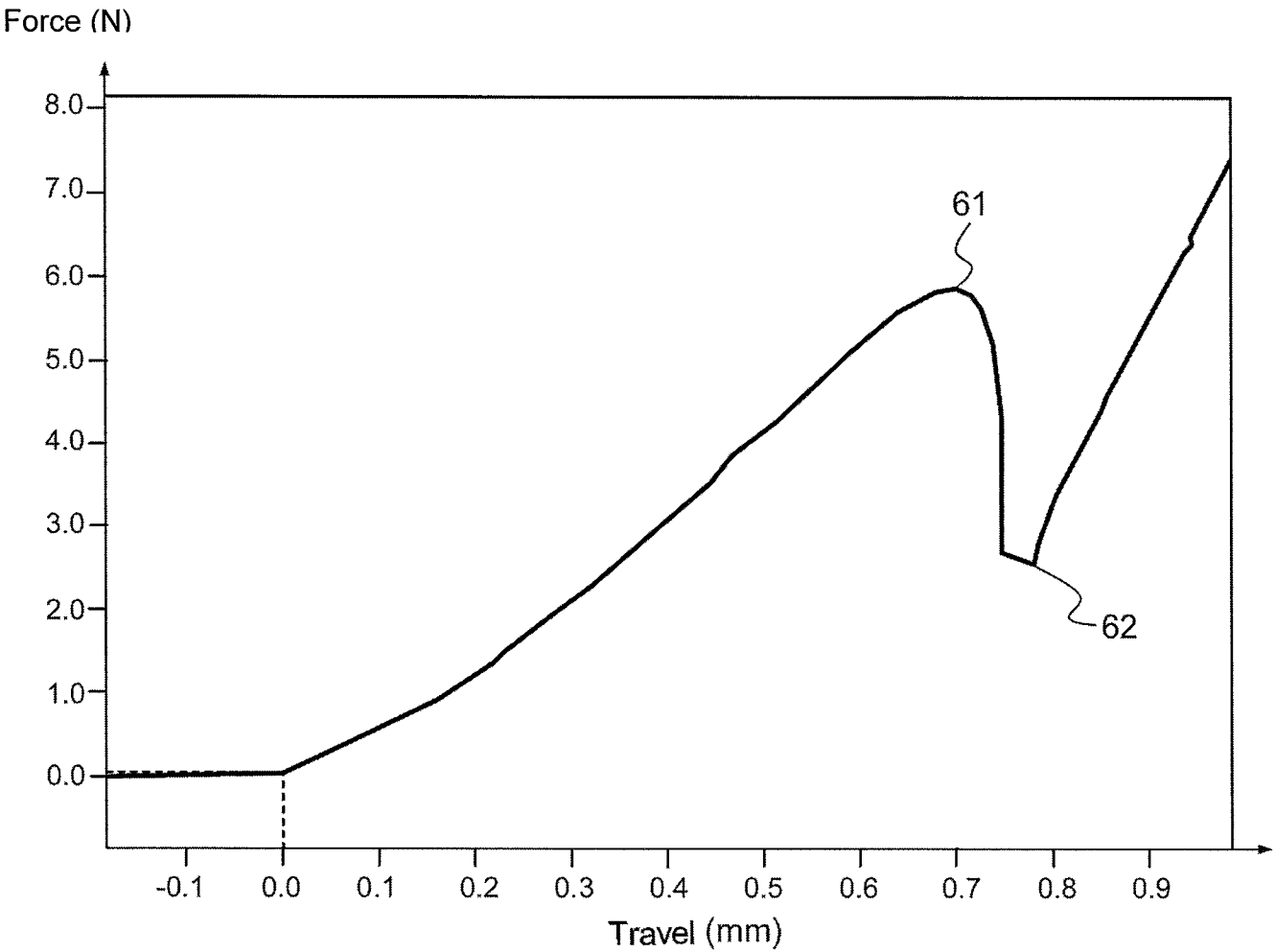

FIG. 3*d* shows the travel-force curve relating to a practical exemplary embodiment of the upper dome positioned above the lower dome via the intermediate mobile part in a configuration identical to the configuration illustrated by the curves of FIG. 3*c*, but with an elastomer plunger. The travel-force curve then has an appearance substantially similar to the travel-force curve illustrated by FIG. 3*c*. However, as was explained previously, the use of the elastomer plunger makes it possible to "erase" the discontinuities, and to offer the user a tactile sensation similar to the tactile sensation provoked by an action on a single dome switch. The travel-force curve in fact has an increasing aspect up to an inversion point 61 corresponding to the inversion of the upper dome, then a decreasing aspect up to a point of mechanical abutment and of electric contact 62.

FIG. 4 shows a cross-sectional view illustrating an exemplary pushbutton switch according to an alternative embodiment of the invention in which the lower dome is replaced by a flexible metal platelet 42. The example illustrated by FIG. 4 corresponds to a configuration of the switch 1 similar to the configuration described previously with reference to FIG. 1*f*, that is to say, a configuration in which the first and the second electric circuits are closed.

The plunger 10, the upper dome 11 comprising a bottom surface 11*a* and a top surface 11*b*, the primary contact 111, the intermediate mobile part 13, the primary contact 121 and the secondary contact 122 can be configured in a way similar to the example described with reference to FIGS. 1*a* to 1*f*. The lower dome can be replaced by a flexible metal platelet 42, one end of which may, for example, be fixed to a part of the primary contact 121, by fixing means 421 such as a screw or a spot of solder, or any other known fixing means, the other end of the flexible metal platelet 42 resting, for example, on another part of the primary contact 121. In the example illustrated by FIG. 4, the platelet 42 is in a down position which can be likened to the depressed position of the lower dome, and its central portion is in contact with the secondary contact 122, thus ensuring the closure of the second electric circuit.

Similarly, the upper dome 11 and the platelet 42 may be configured so that the force required to depress the upper dome 11 is greater than the force required to depress the platelet 42.

The abovementioned advantages obtained through the present invention emerge clearly from reading the above description. It should be noted that another advantage of the invention lies in the fact that standard domes or platelets, available commercially, can be used in the different embodiments described. The different elements forming a switch as described previously can be directly mounted on a card by a staged circuit, or else can be encapsulated in a package; the electric contacts may also be implemented by encapsulated metal platelets.

The invention claimed is:

1. A pushbutton switch, comprising:

a plunger, the plunger provoking, under an action of pressure by a user, a depression of an upper dome positioned above switching means, any depression of the upper dome necessarily provoking a depression of the switching means, a crest of the upper dome and the switching means having a down position, a first electric contact being produced between a primary contact and a secondary contact of the upper dome forming a first electric circuit when the crest of the upper dome is in the down position, a second electric contact being produced between a primary contact and a secondary contact of the switching means forming a second electric circuit when the switching means is in the down position; and an intermediate mobile part positioned below the upper dome and above the switching means, the intermediate mobile part being electrically conductive at least in its upper portion and electrically linked to the secondary contact of the upper dome, the depression of the upper dome resulting in a closure of said first electric circuit, and the depression of the switching means being brought about by the displacement of at least one of the intermediate mobile part, the top surface of the lower dome, and the bottom surface of the intermediate mobile part being electrically insulating.

2. The pushbutton switch according to claim 1, wherein the switching means is formed by a lower dome.

3. The pushbutton switch according to claim 1, wherein the switching means is formed by a flexible metal platelet.

4. The pushbutton switch according to claim 2, wherein the upper dome and the lower dome are configured so that a force required to depress the upper dome is greater than a force required to depress the lower dome.

5. The pushbutton switch according to claim 3, wherein the upper dome and the lower dome are configured so that a force required to depress the upper dome is greater than a force required to depress the flexible metal platelet.

6. The pushbutton switch according to claim 1, wherein said first electric circuit and said second electric circuit have no electric common mode.

7. The pushbutton switch according to claim 1, wherein said first electric circuit and said second electric circuit ensure an activation of a redundant or secured function.

8. The pushbutton switch according to claim 1, wherein the intermediate mobile part is positioned on a flexible and electrically conductive beam, the beam being fixed at at least one point of the secondary contact of the upper dome by fixing means.

9. The pushbutton switch according to claim 1, wherein at least one among the group consisting of said primary contact, said secondary contact of the upper dome, said primary contact of the switching means, and said secondary contact of the switching means is formed by metallizations produced on a printed circuit card or by encapsulated metal platelets.

10. The pushbutton switch according to claim 2, wherein the upper dome and the lower dome are configured so that the depression of the lower dome is initiated after inversion of the upper dome, the travel-force characteristics of the upper and lower domes allowing for the depression of the upper and lower domes in return for a force that is at least equal to a force required to depress the upper dome alone.

11. The pushbutton switch according to claim 4, wherein the upper dome and the lower dome are configured so that the depression of the lower dome is initiated after inversion of the upper dome, the travel-force characteristics of the upper and lower domes allowing for the depression of the upper and lower domes in return for a force that is at least equal to the force required to depress the upper dome alone.

12. The pushbutton switch according to claim 1, wherein the pushbutton switch is configured to be directly mounted on a printed circuit card.

13. The pushbutton switch according to claim 1, wherein the pushbutton switch is arranged in a housing which is configured to be mounted on an instrument panel.

* * * * *